US006865750B2

(12) United States Patent
Nunnery

(10) Patent No.: US 6,865,750 B2
(45) Date of Patent: Mar. 15, 2005

(54) PERSPIRATION BAND FOR HEADGEAR

(76) Inventor: Milton Nunnery, 602 Franklin, Gretna, LA (US) 70053

( * ) Notice: Subject to any disclaimer, the term of this patent is extended or adjusted under 35 U.S.C. 154(b) by 0 days.

(21) Appl. No.: 10/639,346

(22) Filed: Aug. 12, 2003

(65) Prior Publication Data

US 2005/0034214 A1 Feb. 17, 2005

(51) Int. Cl.[7] ..... A42B 1/00
(52) U.S. Cl. ..... 2/181
(58) Field of Search ..... 2/181, 181.4, 209.13

(56) References Cited

U.S. PATENT DOCUMENTS 1,498,505 A * 6/1924 Buchanan ..... 2/181
4,468,817 A * 9/1984 Nunnery et al. ..... 2/181
RE33,430 E * 11/1990 Nunnery et al. ..... 2/181
5,058,210 A * 10/1991 Tivis ..... 2/181
5,265,279 A * 11/1993 Mathis ..... 2/181
6,467,095 B1 * 10/2002 Nunnery ..... 2/181.6

* cited by examiner

*Primary Examiner*—Katherine M. Moran
(74) *Attorney, Agent, or Firm*—Keaty Professional Law Corporation

(57) ABSTRACT

A perspiration band for a headgear formed from a moisture-absorbing material for protecting forehead and temples of the user from contact with the non-absorbent headband. The perspiration band has an irregularly-shaped unitary body defined by a first straight edge and an opening edge that has an outwardly extending tab. The perspiration band is adapted for positioning over a headband of the headgear when folded lengthwise and with the securing members engaged.

5 Claims, 2 Drawing Sheets

PERSPIRATION BAND FOR HEADGEAR

BACKGROUND OF THE INVENTION

This invention relates to headgear accessories, and more particularly to a band for absorbing perspiration of a user who wears hardhat, welding shield, and the like.

Various industrial fields require workers to wear special head-protective headgear, such as hard hats or welding shields during working hours. The hard hats and welding shields are conventionally provided with a flexible, non-absorbing headgear band made of plastic. The headgear band is positioned in the interior of the hardhat and encircles the interior wall of the hardhat, allowing the user to adjust the circumference of the band for a better fit.

The headgear band contacts the skin of the user and, when user perspires, does not absorb the perspiration. As a result, the user may develop a rash, itch, and redness of the skin in the areas, where the plastic band rubs against the forehead. The headgear band is usually secured inside the hardhat with the help of upwardly extending segments that are connected together at the apex of the headgear.

Various solutions have been offered to help absorb perspiration when wearing a hardhat. One such solution is disclosed in our earlier Pat. No. Re. 33,430 issued on Nov. 13, 1990. Another solution is shown in our U.S. Pat. No. 6,467,095 issued on Oct. 22, 2002.

While the perspiration bands in accordance with the above patents work satisfactorily in many cases, it has been observed that the design of the perspiration band shown in the prior patents may not be particularly beneficial in all hardhat applications.

The present invention contemplates provision of a perspiration band that provides better fit and adaptability to headgear headbands now used in hardhats and other similar headgear.

SUMMARY OF THE INVENTION

It is, therefore, an object of the present invention to provide a moisture-absorbent perspiration band that can be used with a wide variety of headgear.

It is another object of the present invention to provide a moisture absorbing perspiration band that is easy to position and easy to remove for regular cleaning and washing.

It is a further object of the present invention to provide an improved moisture-absorbent perspiration band for headgear, wherein headgear has four upwardly extending strips that secure the circular band inside the headgear.

These and other objects of the present invention are achieved through a provision of a flexible body made from moisture-absorbing material adapted for positioning on the headband of a headgear. The flexible body has a unitary construction; its periphery is defined by a first elongated straight edge, a pair of straight sides and a second edge opposite the first edge. The second edge has a first straight portion, a second straight portion and a central tab that extends outwardly from the first portion and the second portion.

A plurality of mating securing members, such as snaps or hook-and-loop fasteners, are secured along the edges of the flexible body; the securing members are engaged together when the flexible body is positioned over the headband of a headgear and is folded lengthwise.

The linear dimension of the second edge is greater than the linear dimension of the first straight edge to accommodate for the curvature of a standard headband without forming wrinkles in the perspiration band.

BRIEF DESCRIPTION OF THE DRAWINGS

Reference will now be made to the drawings, wherein like parts are designated by like numerals and wherein.

DETAILED DESCRIPTION OF THE PREFERRED EMBODIMENT

Figure 1:
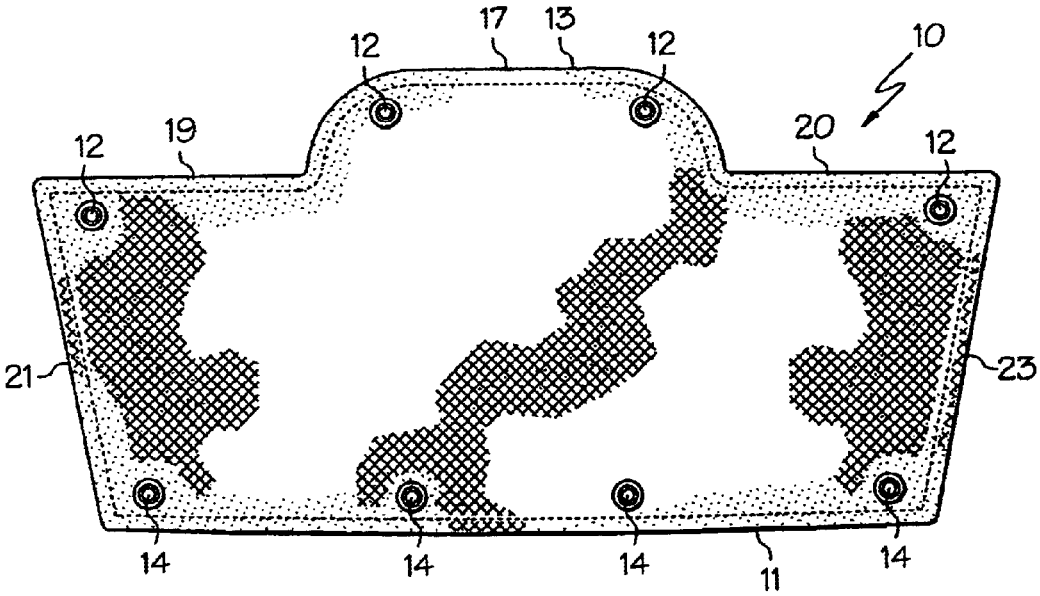
FIG. 1 is a plan view of the perspiration band in accordance with the present invention.

Turning now to the drawings in more detail, numeral 10 designates the moisture-absorbing perspiration band of the present invention. As can be seen in the drawings, the perspiration band 10 comprises a unitary body of an irregular shape. The perspiration body is defined by a first edge 11, a second edge 13, a first side 21 and a second side 23. The sides 21 and 23 extend at an obtuse angle in relation to the first edge 11. The second edge 13 has greater linear dimension than the first edge 11.

The second edge 13 is divided into roughly three portions: a central tab 17, a first portion 19, and a second portion 20. The first portion 19 and the second portion 20 are defined as straight edges extending in a substantially parallel relationship to the first edge 11. The portions 19 and 20 form acute angles with the sides 21 and 23, respectively.

In the embodiment shown in FIG. 1, the central tab 17 is defined by an arcuate edge and extends outwardly from the main body of the band 10 and outwardly in relation to the first portion 19 and the second portion 20. The outer edge of the central tab 17 need not be arcuate although it is preferred that it extend at least some distance outwardly from the main body of the band 10. The central tab 17 has a sufficient extension to accommodate the upward curvature of the headgear within which the headband 10 is to be positioned.

The perspiration band 10 further comprises means for securing the band on the headgear headband. A plurality of mating securing member are attached to the body 10 along the edges and sides of the perspiration band 10. A plurality of securing members 14 is attached along the edge 11. In the embodiment illustrated in FIG. 1, there are four securing members 14 attached along the first edge 11. Two of the securing members 14 are located in the corners of the perspiration band 10 between the sides 21 and 23 and the edge 11. Two central securing members 14 are positioned adjacent an imaginary center line passing across the perspiration band 10.

A plurality of mating securing members 12 are mounted along the edge 13. A pair of securing members 12 are located in the corners of the band 10 between the first portion 19 and the second portion 20, and the sides 21 and 23, respectively. A pair of central securing members 12 are also located in the central tab 17 at location further from the imaginary center line than the mating securing members 14. The distance between the securing members 12 and the imaginary center line is greater than the distance between the securing members 14 and the imaginary center line to better accommodate the curvature of the headband 18 of the headgear 22. The variable distance between the mating securing members 12 or 14 and the center of the perspiration band 10 also facilitates a wrinkle-free mounting of the perspiration band 10 on the headband 18.

Figure 2:
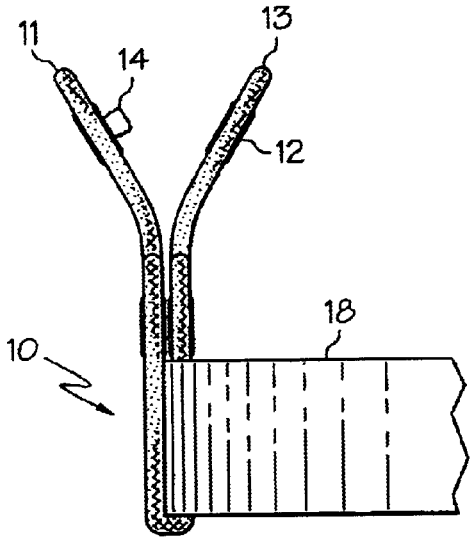
FIG. 2 is a detail view showing positioning of the perspiration band of the present invention in relation to the circular headgear headband.

In operation, the user folds the perspiration band 10 approximately in half lengthwise and positions the perspiration band 10 around the headband 18 of the headgear 22. The edge 11 and the edge 13 are brought together allowing the mating securing members 12 and 14 to be secured above the headband 18, as shown in FIG. 2.

Figure 3:
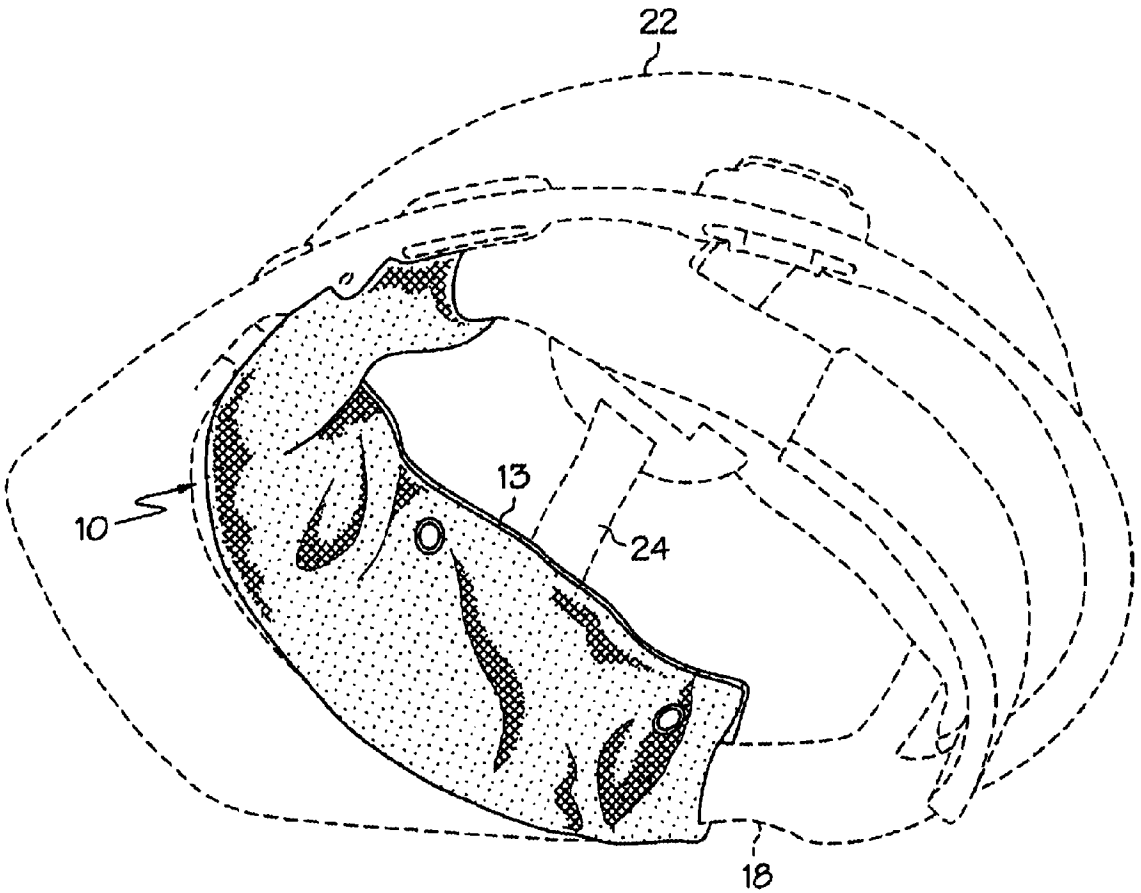
FIG. 3 is a perspective view of the perspiration band of the present invention positioned in a hardhat.

Then, the user engages the securing members 12 and 14 together. The central securing members 12 located in the tab 17 are secured with the central securing members 14 located along the edge 11, enclosing the parts of the headband 18 where it contacts the forehead of the user. As can be seen in FIG. 3, the perspiration band 10 is placed above the headband 18 without interfering with the upwardly extending strips 24 of the hardhat 22.

It is preferred that the perspiration band 10 be formed from soft, flexible, moisture-absorbing material, for instance terrycloth, cotton, or cotton jersey. The securing members 12 and 14 may be snaps or pieces of hook and loop fasteners, if desired. The perspiration band 10 may be impregnated with anti-bacterial solution or a moisturizing cream to prevent skin irritation of the user, especially in an environment such as construction sites, where sand and dust are present.

Many changes and modifications can be made in the design of the present invention without departing from the spirit thereof. We, therefore, pray that our rights to the present invention be limited only by the scope of the appended claims.

I claim:

1. A perspiration band for headgear, comprising:

a flexible unitary body defined by a first elongated edge, a first side, a second side and a second edge opposite the first edge, said second edge having an outwardly extending central tab, a first straight portion and a second straight portion oriented in a substantially parallel relationship to the first edge, said first straight portion and said second straight portion are each being oriented at an acute angle in relation to the adjoining first side and second side, respectively; and a plurality of securing members attached along the first edge and the second edge, said securing members being attached together when said flexible body is positioned on a headband of a headgear.

2. The device of claim 1, wherein said flexible body is formed from a moisture-absorbing material.

3. The device of claim 1, wherein said first edge is oriented at an obtuse angle in relation to the first side and to the second side.

4. The device of claim 1, wherein said securing members comprise mating members secured in corners of the flexible body.

5. The device of claim 4, wherein said securing members further comprise securing members mounted on the central tab and opposing securing members mounted along the first edge.

* * * * *